US006817319B1

(12) United States Patent
Manay

(10) Patent No.: US 6,817,319 B1
(45) Date of Patent: Nov. 16, 2004

(54) BOILER

(75) Inventor: Atilhan Manay, Pueblo, CO (US)

(73) Assignee: Precision Boilers, Inc., Morristown, TN (US)

( * ) Notice: Subject to any disclaimer, the term of this patent is extended or adjusted under 35 U.S.C. 154(b) by 0 days.

(21) Appl. No.: 10/721,918

(22) Filed: Nov. 25, 2003

(51) Int. Cl.[7] ..... F22B 17/10
(52) U.S. Cl. ..... 122/235.23; 122/235.11
(58) Field of Search ..... 122/235.11, 235.23, 122/235.15, 235.16, 273, 338, 351

(56) References Cited

U.S. PATENT DOCUMENTS

| | | | | |
|---|---|---|---|---|
| 1,304,499 A | | 5/1919 | Meier | |
| 1,855,575 A | * | 4/1932 | Jones | 122/32 |
| 3,195,516 A | | 7/1965 | Vorkauf | |
| 3,386,420 A | * | 6/1968 | Cleaver et al. | 122/235.11 |
| 3,518,973 A | | 7/1970 | Herzenberg | |
| 3,693,598 A | * | 9/1972 | Cleaver | 122/274 |
| 4,355,602 A | | 10/1982 | Cooke | |
| 4,357,907 A | | 11/1982 | Campbell, Jr. et al. | |
| 4,612,879 A | | 9/1986 | Cooke | |
| 5,050,542 A | | 9/1991 | Cooke | |
| 5,870,976 A | | 2/1999 | Cooke | |

* cited by examiner

*Primary Examiner*—Gregory Wilson
(74) *Attorney, Agent, or Firm*—Pitts & Brittian, P.C.

(57) ABSTRACT

A boiler (10) in which a liquid medium is heated and steam is generated. The boiler (10) includes a housing (12), and a burner (25) for generating hot combustion gases within the housing (12). The boiler also includes a lower drum (30) for receiving the liquid medium, and an upper drum (36) for receiving steam which is generated. A plurality of first tube banks (44) are disposed on both sides of the upper drum (36). The first tube banks (44) including a plurality of first fluid tubes (42) for establishing fluid communications between the lower and upper drums (30, 36), with each first fluid tube defining at least one inwardly extending portion (52). Also provided are a plurality of second tube banks (46) disposed on both sides of the upper drum (36), with the second tube banks (46) being disposed substantially opposite the first tube bank (44). The second tube banks (46) including a plurality of second fluid tubes (43) for establishing fluid communications between the lower and upper drum (30, 36), with each second fluid tube (43) defining at least one inwardly extending portion (68) which is longer than the inwardly extending portions (52) of the first fluid tubes (42), whereby the first and second tube banks define a combustion area (82) within said housing, and cooperatively define with the housing (12) at least a first level of passageways for communicating hot gases across the housing.

18 Claims, 9 Drawing Sheets

BOILER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention relates to a boiler for heating a liquid and generating steam. More specifically, the present invention is related to water-tube boilers wherein water is heated in tubes which pass through a combustion chamber.

2. Description of the Related Art

Water-tube boilers are well known in the art. In a typical water-tube boiler, water is heated in tubes that pass through a combustion chamber. The heat from the combustion gases within the combustion chamber is transferred to the water inside the tubes, and the water is converted into steam. The steam which is generated is typically routed to a drum such that the steam is available for various uses, including power generation and heating. In order to maximize the efficiency of the boiler it is desirable to position the boiler tubes within the combustion chamber such that there is efficient transfer of heat from the hot gases generated within the combustion chamber to the water within the boiler tubes. In an effort to improve the transfer of heat to the water within the boiler tubes, boilers have been designed which incorporate a plurality of tubes disposed in tube banks, with the tubes being bent in various configurations. Typical of such boiler designs is the boiler disclosed in U.S. Pat. No. 5,050,542. In this boiler banks of tubes are used to create superposed passageways within the combustion chamber through which the heated gases consecutively pass, in an effort to achieve greater exposure of the tubes, and the water therein, to the heated gases. Other water-tube boiler designs are disclosed in U.S. Pat. Nos. 5,870,976; 4,357,907; 4,355,602; 4,612,879; 3,518,973; 3,195,516; and 1,304,499.

BRIEF SUMMARY OF THE INVENTION

The present invention provides a boiler for generating steam or for heating a liquid medium such as water. The boiler includes a housing having opposite sidewalls, first and second opposite end walls, a base, and a roof. A burner is mounted on the first end wall of the housing for generating hot combustion gases within the housing. The boiler also includes a lower drum for receiving the liquid medium, and an upper drum for receiving the liquid medium and steam generated from the liquid medium, with a steam outlet being provided in the upper drum. A plurality of first fluid tubes are provided which establish fluid communication between the upper and lower drums, with the first fluid tubes being arranged in first tube banks disposed within the housing on both sides of the upper and lower drums. Each of the first fluid tubes is bent to form a pair of inwardly extending portions such that a serpentine configuration is defined. A plurality of second fluid tubes are also provided which establish fluid communication between the upper and lower drums, with the second fluid tubes being arranged in second tube banks disposed within the housing on both sides of the upper and lower drums. In this regard, the first and second tube banks are alternately positioned along each side of the upper and lower drums, and each first tube bank is oppositely disposed from a second tube bank on the opposite side of the upper and lower drums.

Each of the second fluid tubes is bent to form a pair of inwardly extending portions such that a serpentine configuration is defined, the inwardly extending portions of the second fluid tubes being longer than the inwardly extending portions of the first fluid tubes. As a consequence of the configurations of the first and second fluid tubes, and the differing lengths of their respective inwardly extending portions, the first and second tube banks define a combustion area, a first level of passageways for communicating hot gases which defines three separate passageways, a second level passageway for communicating hot gases, and a third level of passageways for communicating hot gases which defines three separate passageways. Further, gas flow is permitted between the first level passageways and the third level passageways so as to allow both linear and serpentine gas flow through the passageways at such levels.

The boiler also includes a plurality of oppositely disposed third fluid tubes proximate the second end wall of the housing for communicating fluid between the lower and upper drum, and a plurality of oppositely disposed fourth fluid tubes proximate the first end wall of the housing for communicating fluid between the lower and upper drum. The third fluid tubes are bent to permit hot gases to be communicated from the combustion area to the first level passageways and from the second level passageway to the third level passageways. The fourth fluid tubes are bent to permit hot gases to be communicated from the first level passageways to the second level passageway and from the third level passageways to the upper interior portion of the housing.

With respect to operation of the boiler of the present invention, water, or another liquid medium, is supplied to the lower drum and the first second and third fluid tubes. The burner is used to generate hot gases in the combustion area defined by the fluid tubes, and such combustion gases travel toward the second end wall of the housing. The configuration of the third fluid tubes allows the hot combustion gases from the combustion area to be communicated to the first level passageways proximate the second end wall of the housing. The hot combustion gases then travel down the first level passageways toward the first end wall of the housing where the configuration of the fourth fluid tubes allows the gases to be communicated to the second level passageway. The hot combustion gases then travel down the second level passageway toward the second end wall of the housing where the configuration of the third fluid tubes allows such gases to be communicated to the third level passageways. The gases then travel down the third level passageways toward the first end wall of the housing where the configuration of the fourth fluid tubes allows the gases to be communicated to the upper portion of the housing where the gases travel across the housing to be exhausted through a flue opening in the housing which is provided in the roof of the housing proximate the second end wall. As the hot gases pass through the various passageways, heat from the gases is transferred to the fluid within the various fluid tubes, and steam is generated in the upper drum.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
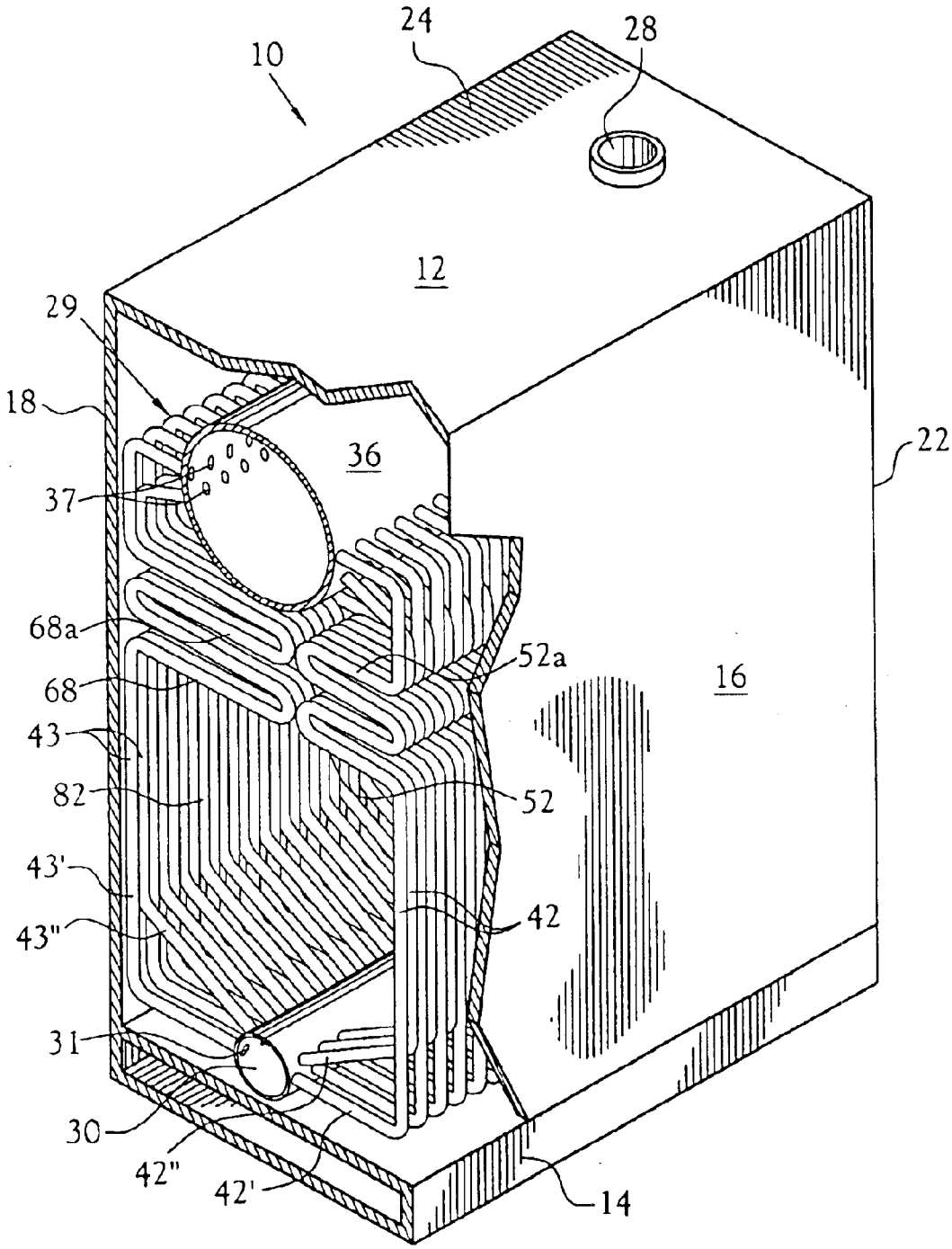
FIG. 1 is a perspective view, in section, of a boiler of the present invention.

A boiler in accordance with the present invention is illustrated generally at 10 in the drawings. The boiler 10 can be utilized for heating water to generate steam which can be used for heating, power generation, or various other applications. However, it will be understood that liquid mediums other than water can be used, and for certain applications the boiler 10 can be used for producing a heated liquid rather than steam. Therefore, any references herein to the use of water as a medium, or to the application of the boiler 10 to the generation of steam, are not intended as limitations to the scope of the appended claims.

Figure 2:
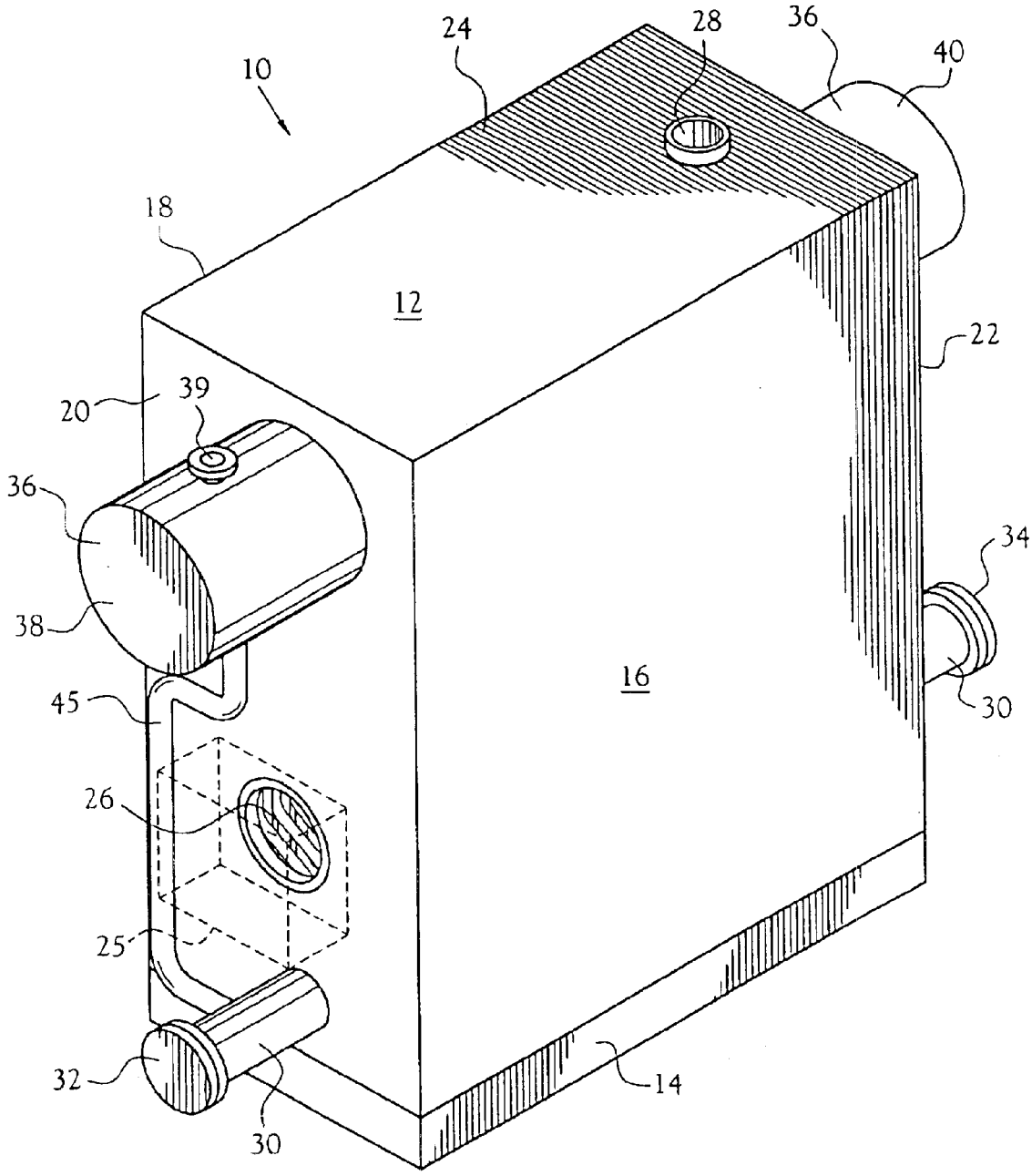
FIG. 2 is a perspective view of a boiler of the present invention.
Figure 3:
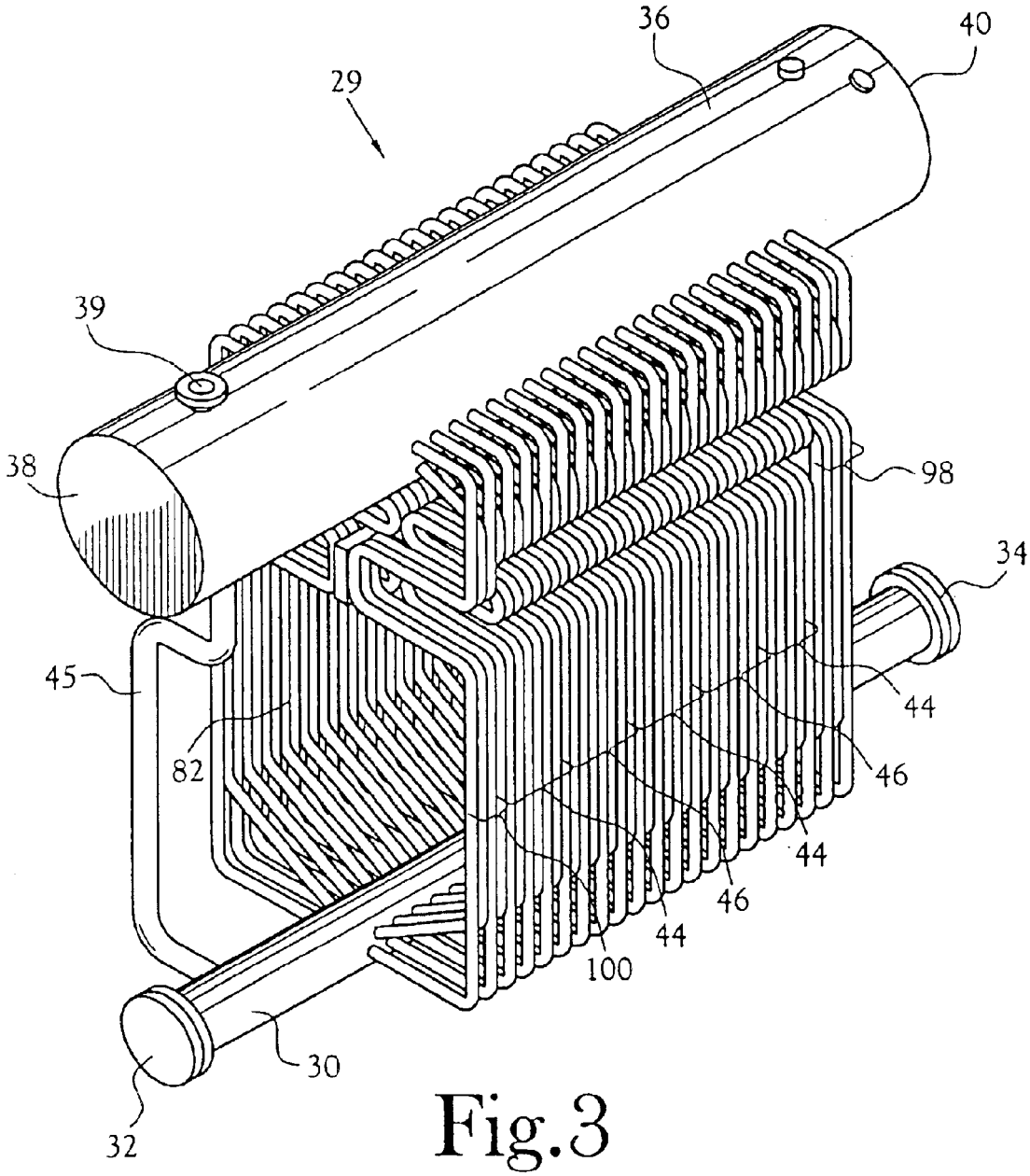
FIG. 3 is a perspective view of the heat exchanger assembly of a boiler of the present invention.

The boiler 10 generally includes a housing 12 having a base 14, and first and second sidewalls 16 and 18, respectively. The housing 12 also has first and second end walls 20 and 22, respectively, and a roof 24. As illustrated in broken lines in FIG. 2, a burner 25 is mounted on the first end wall 20. As will be discussed further below, the burner 25 is used to generate hot gases within the housing 12. In this regard, an opening 26 accessing the interior of the housing 12 is provided in the end wall 20 to accommodate the mounting of the burner 25, and to facilitate the heating of the interior of the housing 12. Further, the roof 24 is provided with a flue opening 28 through which combustion gases are exhausted from the housing 12.

The boiler 10 also includes a heat exchanger assembly 29 having a lower drum 30 for receiving water, or another liquid medium, to be heated in the boiler 10. The lower drum 30 is mounted so as to extend across the interior of the housing 12 proximate the base 14. In this regard, in the preferred illustrated embodiment the lower drum 30 spans the interior of the housing 12, and a first end 32 of the lower drum extends through the first end wall 20, and a second end 34 of the lower drum 30 extends through the second end wall 22 of the housing 12. An upper drum 36 is also provided for receiving water, or another liquid medium, and the steam generated from the heating process. The upper drum 36 is mounted so as to extend across the interior of the housing 12 proximate the roof 24. In the preferred illustrated embodiment, the upper drum 36 spans the interior of the housing 12, and a first end 38 of the upper drum extends through the first end wall 20, and a second end 40 of the upper drum 30 extends through the second end wall 22 of the housing 12. Further, the upper drum 36 is provided with a steam outlet 39 through which the steam generated by the boiler 10 is removed from the upper drum 36.

Figure 4:
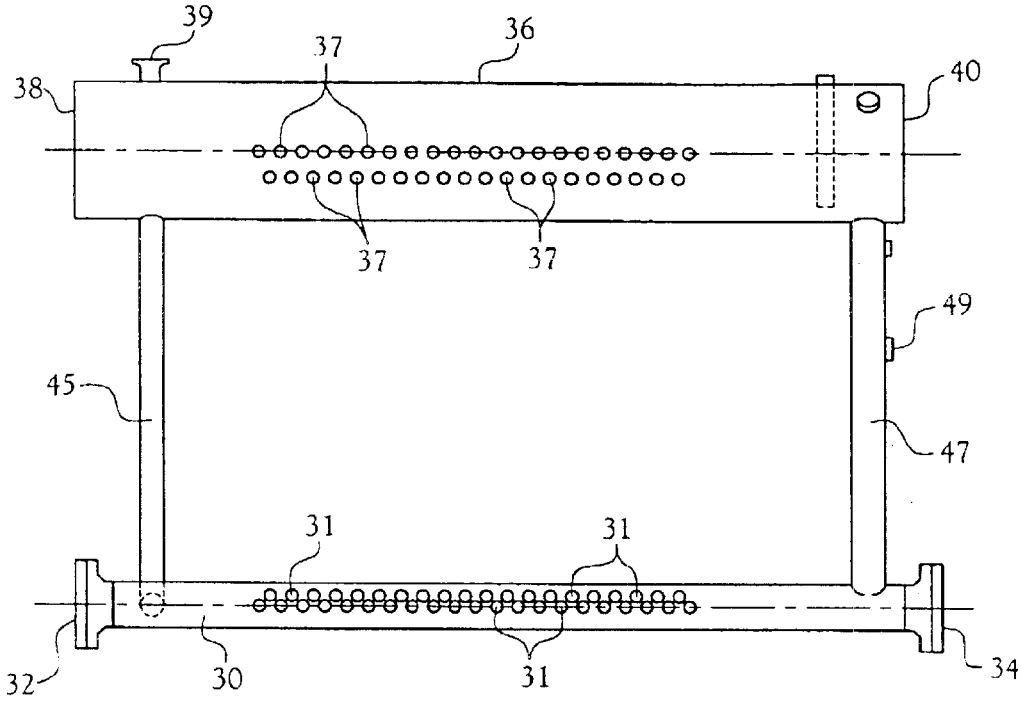
FIG. 4 is a side elevation view of the upper and lower drums and downcomers of a boiler of the present invention.

The heat exchanger 29 also includes a plurality of fluid tubes 42 and a plurality of fluid tubes 43 within the housing 12 which establish fluid communication between the lower drum 30 and the upper drum 36 thereby allowing water, or another medium, to be communicated from the lower drum 30 to the upper drum 36. As will be discussed with respect to FIGS. 6A and 6B, in the preferred embodiment two different configurations of the fluid tubes 42 are provided and two different configurations of the fluid tubes 43 are provided. However, both configurations of such fluid tubes will be generally referred to herein as fluid tubes 42 and 43. The fluid tubes 42 and 43 are arranged in opposing tube banks, with each tube bank being made up of a plurality of tubes disposed adjacent to one another. For example, in the preferred illustrated embodiment of FIG. 5, the tube banks 44 are made up of a plurality of the tubes 42 and the opposing tube banks 46 are made up of a plurality of the tubes 43. First and second downcomers 45 and 47 are also provided to allow liquid water, or another liquid medium, to be communicated from the upper drum 36 to the lower drum 30. In the preferred illustrated embodiment the second downcomer 47 is provided with an inlet 49 (see FIG. 4) through which the heat exchanger assembly 29 is supplied with water, or another liquid medium. It will, however, be recognized that the inlet 49 could alternatively be located in other components of the assembly 29.

Figure 6A:
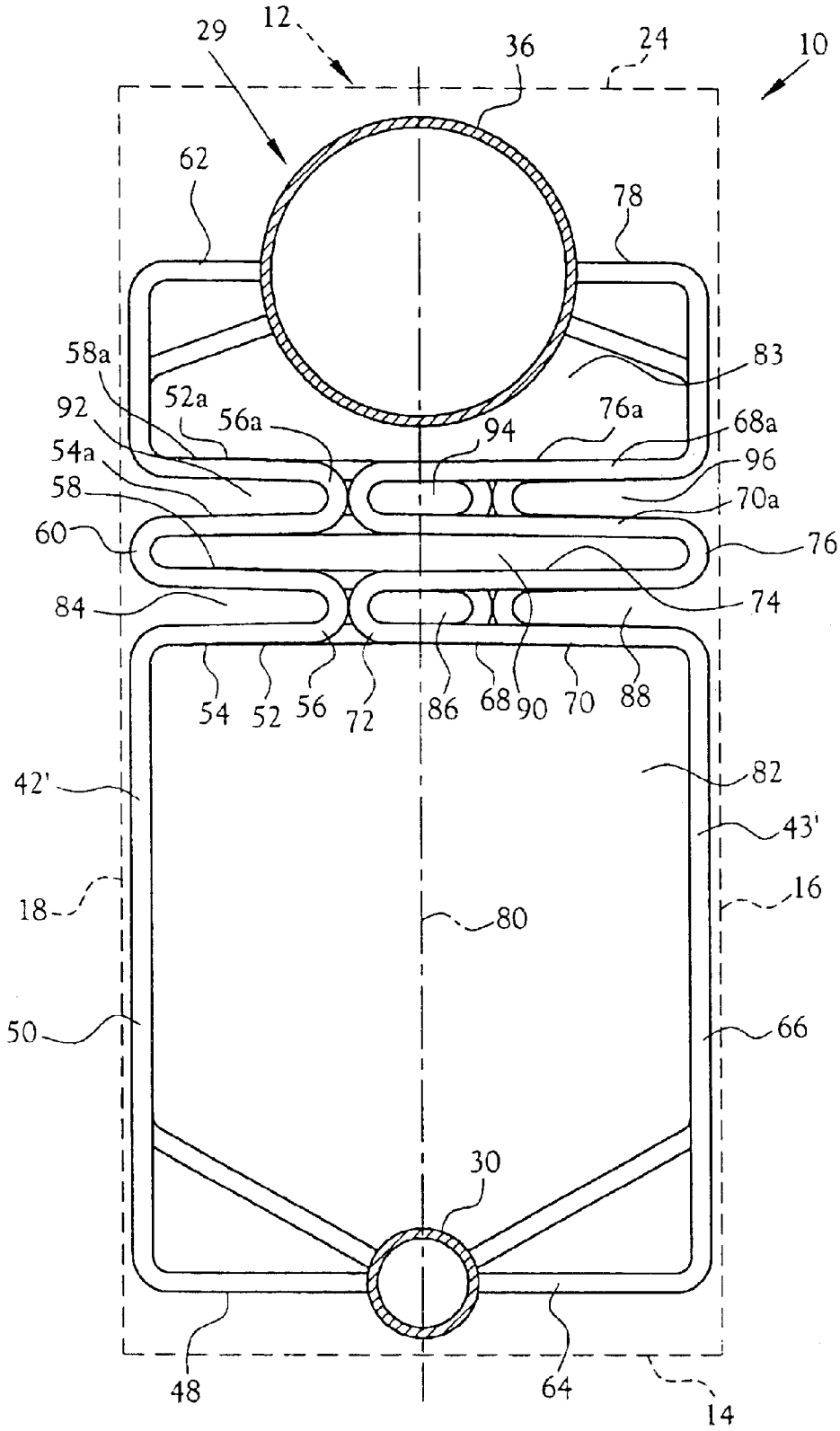
FIG. 6A is an end view of fluid tubes of the heat exchanger assembly of a boiler of the present invention.
Figure 6B:
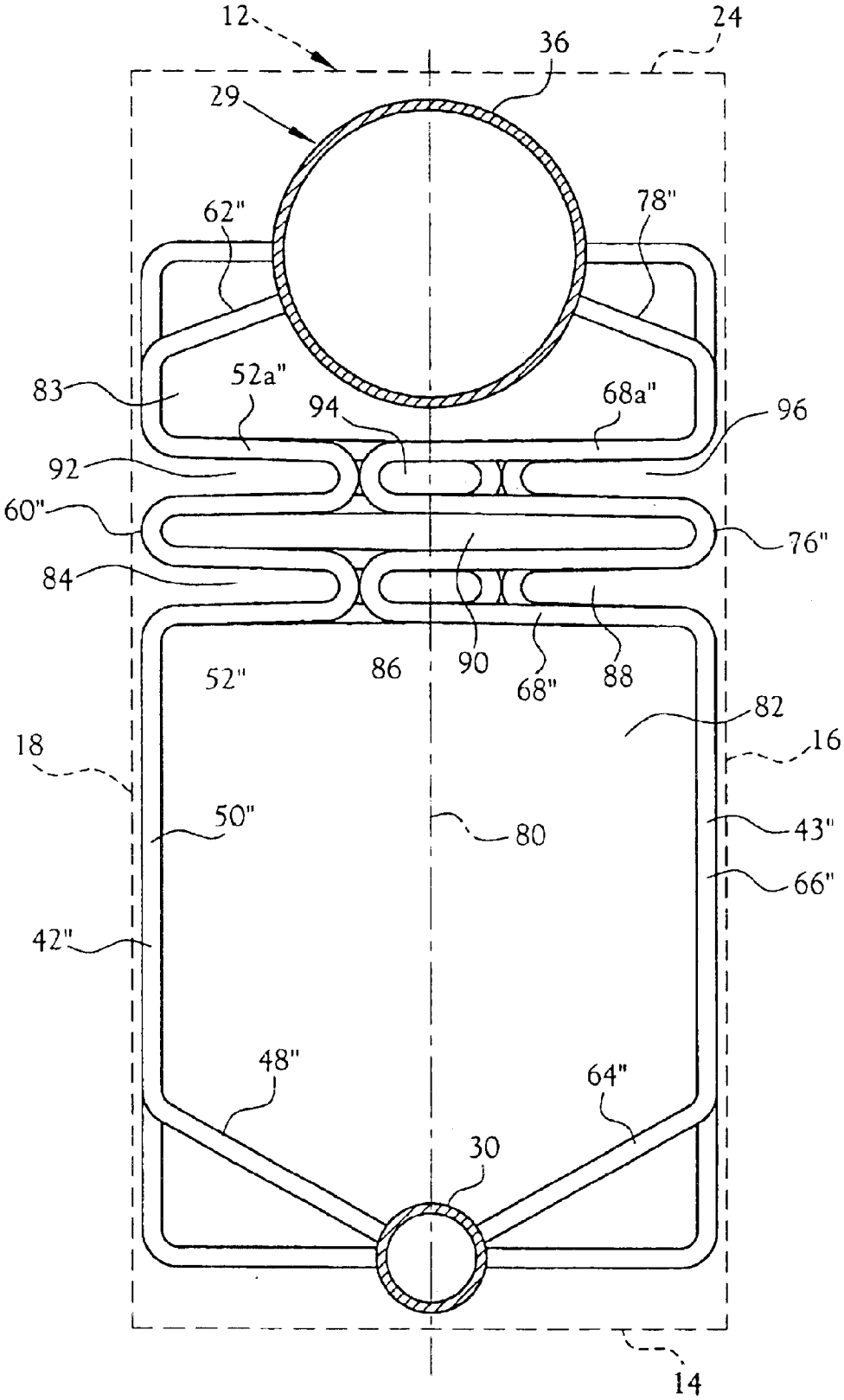
FIG. 6B is an end view of fluid tubes of the heat exchanger assembly of a boiler of the present invention.

As noted above, in the preferred embodiment two different configurations of the fluid tubes 42 and 43. are provided. In FIGS. 6A and 6B the different configurations of the tubes 42 are referenced as 42' and 42" and the different configurations of the tubes 43 are referenced as 43' and 43". As illustrated, each of the tubes 42' defines a lower leg portion 48 which extends a selected distance from the lower drum 30 outwardly toward the associated sidewall 16 or 18 of the housing 12, and bends to define an upwardly extending portion 50. Each of the tubes 42' also defines at least a first inwardly extending portion 52 having a first tube run 54, a reverse bend 56, and a second tube run 58. The first tube run 54 extends inwardly from the upwardly extending portion 50 and away from the operatively associated sidewall 16 or 18 to the reverse bend 56. The second tube run 58 extends from the reverse bend 56 to a point at or proximate the operatively associated sidewall. In the preferred illustrated embodiment, a second inwardly extending portion 52*a* is provided above the inwardly extending portion 52 with a second reverse bend 60 extending between the inwardly extending portions 52 and 52*a*. As illustrated, the inwardly extending portion 52*a* has a first tube run 54*a*, a reverse bend 56*a*, and a second tube run 58*a*. Accordingly, the first and second inwardly extending portions 52 and 52*a*, with the second reverse bend 60 therebetween, define a serpentine configuration. From the inwardly extending portion 52*a* each tube 42' extends upwardly proximate the operatively associated sidewall 16 or 18, and is routed to the upper drum 36 via a further tube run 62. It will be understood by those skilled in the art that further inwardly expending portions 52 can be provided to extend the length of the serpentine portion of the tube if desired. It will also be understood that a single portion 52 can be used if desired.

As illustrated in FIG. 6B, the fluid tubes 42" are similar in configuration to the fluid tubes 42'. However, the lower leg portion 48" of the fluid tube 42" is angularly disposed so as to engage the lower drum 30 at a different angle, and at a different point along the circumference of the drum 30 than the lower leg portion 48 of the fluid tube 42'. Similarly, the further tube run 62" is angularly disposed so as to engage the upper drum 36 at a different angle than the further tube run 62 of the fluid tube 42'. In this regard, in the tube banks 44 the adjacent fluid tubes 42 alternate between the fluid tubes 42' and 42", and the different angular disposition of the lower leg portions 48" and further tube runs 62" allows the adjacent fluid tubes to engage the upper and lower drums at different circumferential positions. This construction allows the openings 31 in the lower drum 30 and openings 37 in the upper drum 36, through which the fluid tubes communicate with the upper and lower drums, to be radially offset (see FIG. 4) such that the fluid tubes 42' and 42" can be positioned in close proximity to one another without compromising the structural integrity of the drums 30 and 36. Given the close proximity of the fluid tubes 42' and 42", the tube banks 44 define a wall of fluid tubes along much of the length of the fluid tubes 42.

As illustrated in FG. 6A, each of the tubes 43' defines a lower leg portion 64 which extends a selected distance from the lower drum 30 outwardly toward the associated sidewall 16 or 18 of the housing 12, and bends to define an upwardly extending portion 66. Each tube 43' also defines at least a first inwardly extending portion 68 having a first tube run 70, a reverse bend 72, and a second tube run 74. The first tube run 70 extends inwardly from the upwardly extending portion 66, and away from the operatively associated sidewall 16 or 18, to the reverse bend 72. The second tube run 74 extends from the reverse bend 72 to a point at or proximate the operatively associated sidewall. In the preferred illustrated embodiment, a second inwardly extending portion 68*a* is defined above the inwardly extending portion 68 with a second reverse bend 76 extending between the inwardly extending portions 68 and 68*a*. As illustrated, the inwardly extending portion 68*a* has a first tube run 70*a*, a reverse bend 72, and a second tube run 76*a*. Accordingly, the first and second inwardly extending portions 68 and 68*a*, with the second reverse bend 76 therebetween, define a serpentine configuration. From the inwardly extending portion 68*a*, each tube 43'. extends upwardly proximate the operatively associated sidewall 16 or 18, and is routed to the upper drum 36 via a further tube run 78. It will be understood by those skilled in the art that further inwardly expending portions 68, 68*a* can be provided to extend the length of the serpentine portion of the tube if desired. It will also be understood that a single portion 68 can be used if desired.

As illustrated in FIG. 6B, the fluid tubes 43" are similar in configuration to the fluid tubes 43'. However, the lower leg portion 64" of each fluid tube 43" is angularly disposed so as to engage the lower drum 30 at a different angle than the lower leg portion 64 of the fluid tube 43'. Similarly, the further tube run 78" is angularly disposed so as to engage the upper drum 36 at a different angle than the further tube run 78 of the fluid tube 43'. In this regard, in the tube banks 46, the adjacent fluid tubes 43 alternate between the fluid tubes 43' and 43", and the different angular disposition of the lower leg portions 64" and further tube runs 78" allows the adjacent fluid tubes to engage the upper and lower drum at different circumferential positions. Thus, the fluid tubes 43' and 43" can be positioned in close proximity to one another without compromising the structural integrity of the drums 30 and 36, and given the close proximity of the fluid tubes 43' and 43", the tube banks 46 define a wall of fluid tubes along much of the length of the fluid tubes 43.

Figure 5:
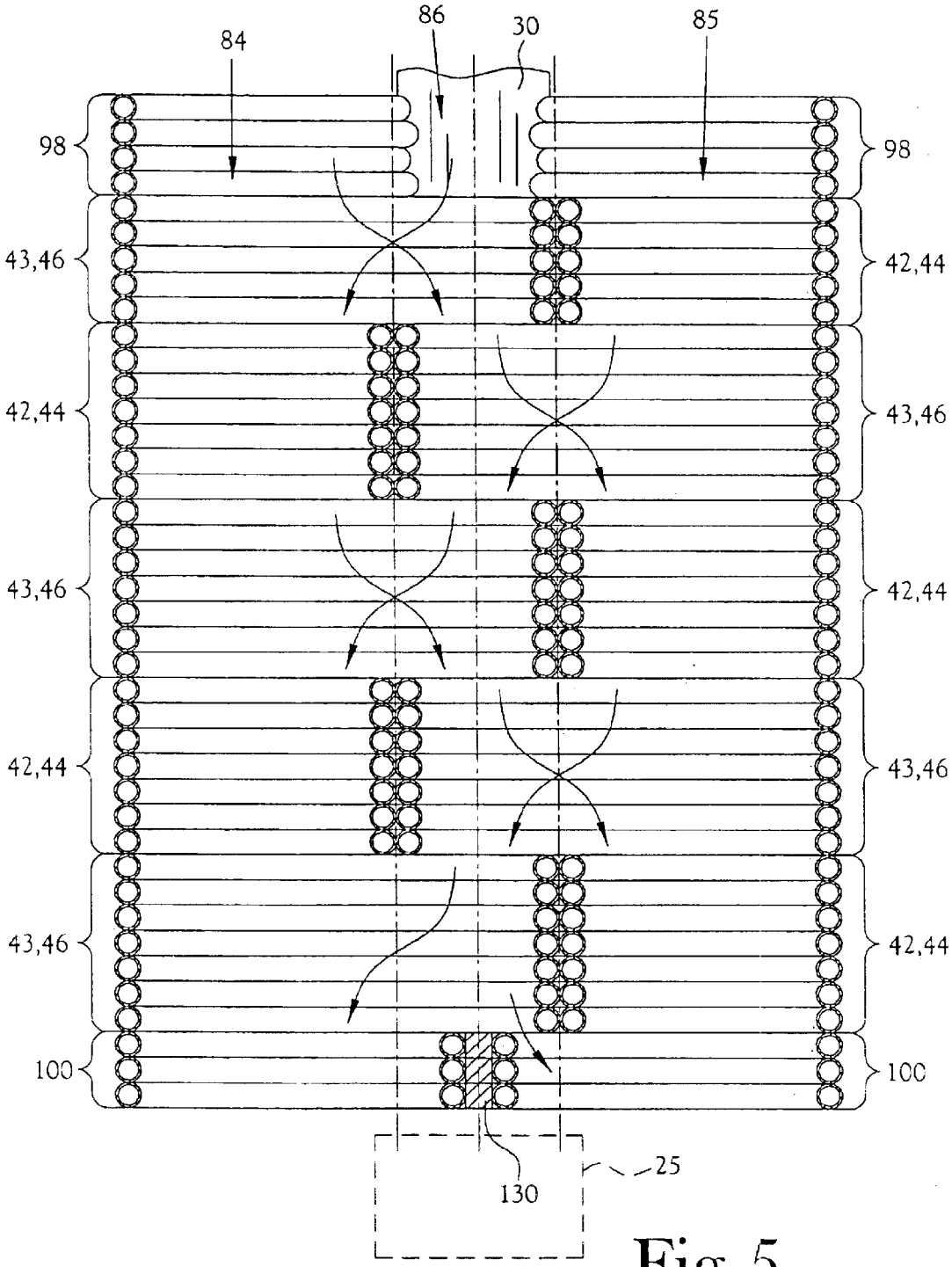
FIG. 5 is a plan view, in section at A—A of FIG. 8A of the heat exchanger assembly of a boiler of the present invention.

It will be noted that the inwardly extending portions 52 and 52*a* of the tubes 42 are shorter than the inwardly extending portions 68 and 68*a* of the tubes 43. In this regard, inwardly extending portions 52 and 52*a* of the fluid tubes 42 extend inwardly to a point short of and selectively spaced from a plane 80 intersecting the axes of the lower drum 30 and the upper drum 36, the plane 80 being proximate the center of the housing 12 in the preferred embodiment. The inwardly extending portions 68 and 68*a* of the fluid tubes 43 extend inwardly to a point beyond the plane 80 such that the inwardly extending portions of the opposing tubes 42 and 43 terminate at least in close proximity to one another. Moreover, as illustrated in FIG. 5, the heat exchanger assembly 29 includes alternating tube banks 44 and 46 on each side of the upper and lower drums 36 and 30. As a consequence of this construction the tubes 42 and 43 define a combustion area 82 in which the burner 25 generates hot combustion gases, and a series of stacked passageways through which such combustion gases are channeled to the upper portion 83 of the interior of the housing 12. As illustrated in FIGS. 6A and 6B, the inwardly extending portions 52 and 68 of the opposing, and alternating, tube banks 44 and 46 define passageways 84, 86, and 88 at a first level above the combustion area 82 which communicate hot combustion gases received from the combustion area. Between the inwardly extending portions 52 and 68 and the inwardly extending portions 52*a* and 68*a* a passageway 90 is defined on a second level above the combustion area 82 which communicates hot combustion gases received from the passageways 84, 86, and 88. Further, the inwardly extending portions 52*a* and 68*a* of the alternating tube banks 44 and 46 define passageways 92, 94, and 96 at a third level above the combustion area 82, which communicate hot combustion gases received from the passageway 90 to the upper portion 83 of the housing 12.

As illustrated in FIG. 5, the alternating disposition of the tube banks 44 and 46 provide not only for linear gas flow down the passageways 84, 86, and 88, but provides for a serpentine flow between such passageways as illustrated by the arrows in FIG. 5. Similarly, both linear and serpentine gas flow is provided through the passageways 92, 94, and 96. This complex combination of linear and serpentine gas flow down the passageways enhances the heat transfer from the combustion gasses within the passageways to the fluid medium within the tubes 42 and 43 thereby increasing the efficiency of the boiler 10.

The heat exchanger assembly 29 also includes structures for directing the gas flow from the combustion area 82 to the passageways 84, 86 and 88, from the passageways 84, 86 and 88 to the passageway 90, from the passageway 90 to the passageways 92, 94 and 96, and from the passageways 92, 94 and 96 to the upper portion 83 of the housing 12. In this regard, in the preferred illustrated embodiment the boiler 10 is provided with at least a pair, and in the illustrated embodiment four pair, of opposing fluid tubes 98 disposed proximate the second end wall 22 of the housing 12, and at least a pair, and in the illustrated embodiment three pair, of opposing fluid tubes 100 disposed proximate the first end wall 20 of the housing 12. The fluid tubes 98 are bent differently from the tubes 42 and 43 to allow combustion gasses to flow from the combustion area 82 to the passageways 84, 86 and 88, and from the passageway 90 to the passageways 92, 94 and 96. Further, the fluid tubes 100 are bent differently from the tubes 42 and 43 to allow combustion gasses to flow from the passageways 84, 86 and 88 to the passageway 90, and from passageways 92, 94 and 96 to the upper portion 83 of the housing 12.

Figure 7B:
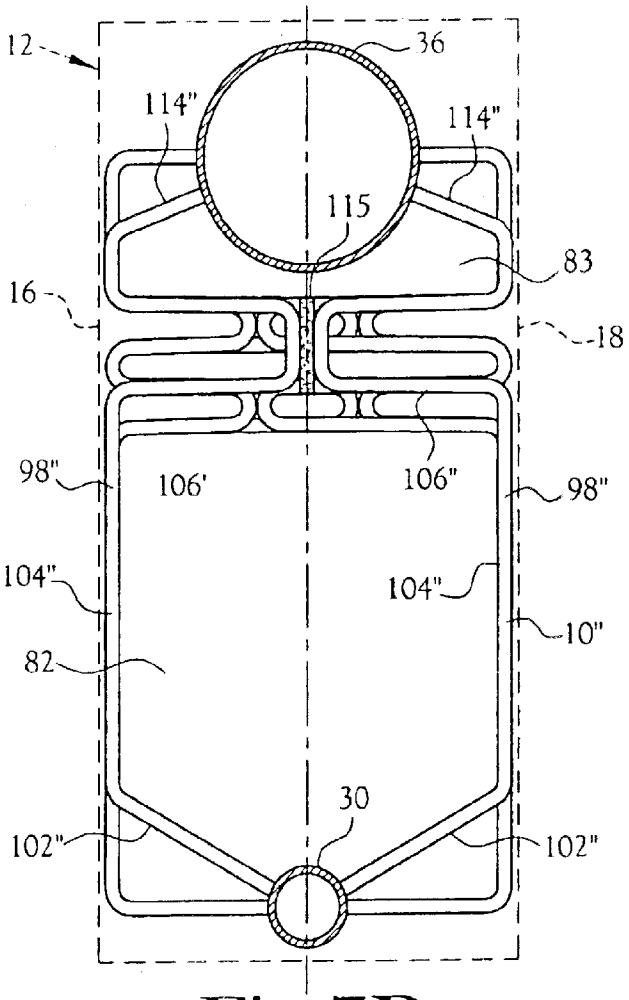
FIG. 7B is an end view of fluid tubes of the heat exchanger assembly of a boiler of the present invention.
Figure 7A:
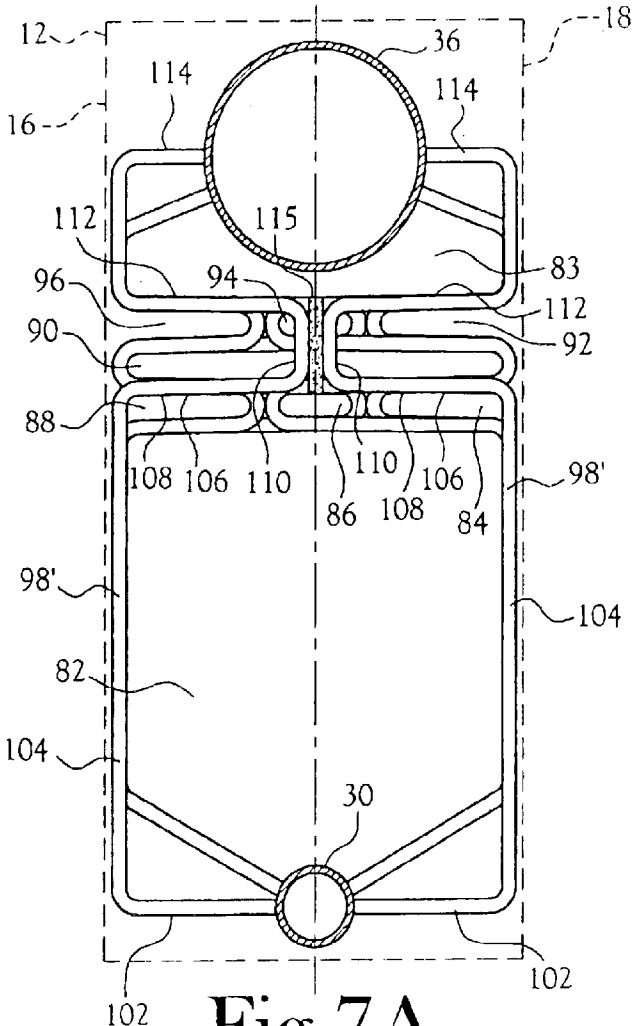
FIG. 7A is an end view of fluid tubes of the heat exchanger assembly of a boiler of the present invention.

More specifically, in the preferred embodiment two different configurations of the fluid tubes 98 are provided, and in FIGS. 7A and 7B, such different configurations are referenced as fluid tubes 98' and 93". Each of the tubes 98' defines an a lower leg portion 102 which extends a selected distance from the lower drum 30 outwardly toward the associated sidewall 16 or 18 of the housing 12, and bends to define an upwardly extending portion 104. Each tube 98' also defines at least one inwardly extending portion 106 having an inwardly extending and substantially horizontal tube run 108, a substantially vertical tube run 110, and an outwardly extending and substantially horizontal tube run 112. It will be recognized that the inwardly extending portions 106 of the opposing fluid tubes 98' are disposed above the first level of passageways 84, 86 and 88) such that the tubes 98' allow fluid communication between the combustion area 82 and the first level of passageways proximate the second end wall 22. However, fluid communications between the first level passageways and the passageway 90 is inhibited proximate the second end wall 22. Further, the inwardly extending portions 106 provide an open area and fluid communications between the second level passageway 90 and the third level passageways 92, 94 and 96 proximate the second end wall 22 while inhibiting fluid communication between the third level passageways and the upper portion 83 of the housing 12. From the inwardly extending portion 106 each tube 98' extends upwardly proximate the operatively associated sidewall 16 or 18, and is routed to the upper drum 36 via a further tube run 114. It will be noted that in the preferred embodiment the inwardly extending portions 106 extend inwardly to a point short of the plane 80 and a baffle 115 is disposed between the inwardly extending portions 106 of opposing fluid tubes 98'.

As illustrated in FIG. 7B, the fluid tubes 98" are similar in construction to the tubes 98'. However, the lower leg portion 102" of each fluid tube 98" is angularly disposed so as to engage the lower drum 30 at a different angle than the lower leg portion 102 of the fluid tube 98'. Similarly, the further tube run 114" is angularly disposed so as to engage the upper drum 36 at a different angle than the further tube run 124 of the fluid tube 98'. In this regard, alternating tubes 98' and 98" are used, and the different angular disposition of the lower leg portions 102" and further tube runs 114" allows the adjacent fluid tubes to engage the upper and lower drum at different angles facilitating the close disposition of the fluid tubes 98.

Figure 8B:
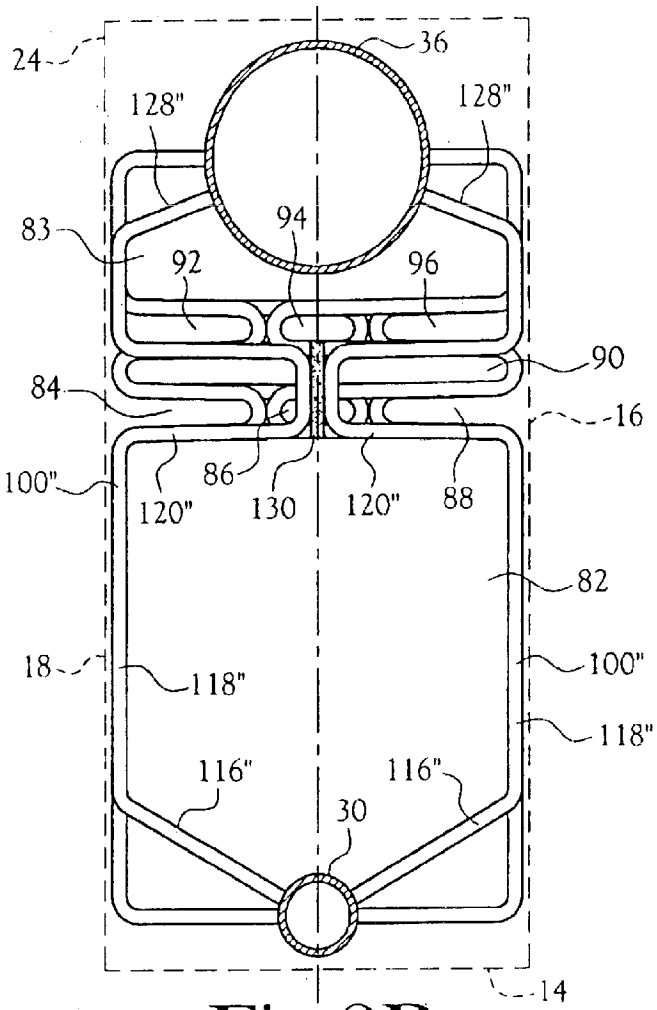
FIG. 8B is an end view of fluid tubes of the heat exchanger assembly of a boiler of the present invention.
Figure 8A:
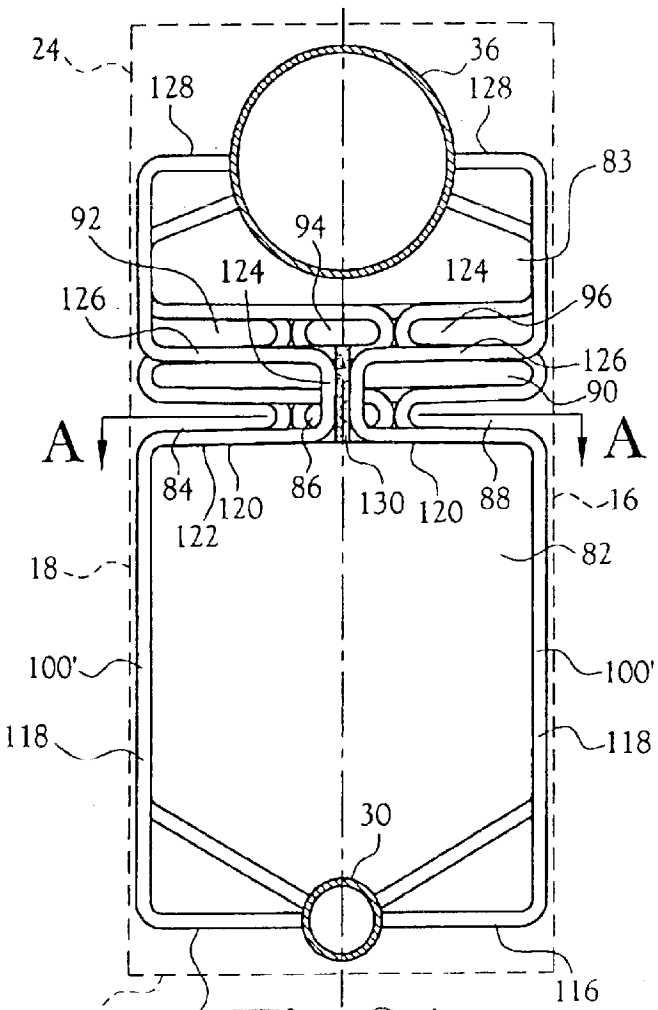
FIG. 8A is an end view of fluid tubes of the heat exchanger assembly of a boiler of the present invention.

With respect to the fluid tubes 100, in the preferred embodiment two different configurations of the fluid tubes 100 are provided, and in FIGS. 8A and 8B, such different configurations are referenced as fluid tubes 100' and 100". Each of the tubes 100' defines a lower leg portion 116 which extends a selected distance from the lower drum 30 outwardly toward the associated sidewall 16 or 18 of the housing 12, and bends to define an upwardly extending portion 118. Each tube 100' also defines at least one inwardly extending portion 120 having an inwardly extending and substantially horizontal tube run 122, a substantially vertical tube run 124, and an outwardly extending and substantially horizontal tube run 126. It will be recognized that the inwardly extending portions 120 of the opposing fluid tubes 100' are disposed above the combustion area 82 such that they inhibit gas flow from the combustion area 82 to the first level of passageways. Further, the inwardly extending portions 120 provide an open area and fluid communications between the first level passageways 84, 86 and 88 and the second level passageway 90 proximate the first end wall 20 of the housing 12. From the inwardly extending portion 120 the tube 100' extends upwardly proximate the operatively associated sidewall 16 or 18, and is routed to the upper drum 36 via a further tube run 128 such that gas flow between passageway 90 and the third level passageways 90, 92 and 94 is inhibited, but gas flow between the third level passages and the upper portion 83 of the housing 12 proximate the first end wall 20 is permitted. It will be noted that in the preferred embodiment the inwardly extending portions 120 extend inwardly to a point short of the plane 80, and a baffle 130 is disposed between the inwardly extending portions 120 of opposing fluid tubes 100'.

As illustrated in FIG. 83, the fluid tubes 100" are similar in construction to the tubes 100'. However, the lower leg portion 116" of each fluid tube 100" is angularly disposed so as to engage the lower drum 30 at a different angle than the lower leg portion 116 of the fluid tube 100'. Similarly, the further tube run 128" is angularly disposed so as to engage the upper drum 36 at a different angle than the further tube run 128 of the fluid tube 100'. In this regard, alternating tubes 100' and 100" are used, and the different angular disposition of the lower leg portions 116" and further tube runs 128" allows the adjacent fluid tubes to engage the upper and lower drum at different angles to facilitate the close disposition of the fluid tubes 100.

Whereas the fluid tubes 98 and 100 provide the preferred structures for communicating hot gases between the combustion area, and the various levels of passageways, to the upper portion of the housing, it will be understood that other structures such as conduits or baffles could alternatively be used.

With respect to operation of the boiler 10, water, or another liquid medium, is supplied to the heat exchanger assembly 29 through the inlet 49 and is communicated into the fluid tubes 42, 43, 98, and 100. The burner 25 is used to generate hot combustion gases in the combustion area 82 defined by the fluid tubes 42 and 43, and such combustion gases travel toward the second end wall 22 of the housing 12. The configuration of the tubes 98 allow the hot combustion gases from the combustion area to be communicated to the first level passageways 84, 86 and 88 proximate the second end wall 22. The hot combustion gases then travel down the first level passageways toward the first end wall 20 of the housing 12, and the configuration of the fluid tubes 100 allows the gases to be communicated to the second level passageway 90. The hot combustion gases then travel down the passageway 90 toward the second end wall 22, and the configuration of the fluid tubes 98 allow such gases to be communicated to the third level passageways 92, 94 and 96. The gases then travel down the third level passageways toward the first end wall 20, and the configuration of the fluid tubes 100 allows the gases to be communicated to the upper portion 83 of the housing where the gases travel across the housing to be exhausted through the flue opening 28 which is disposed proximate the second end wall 22.

It will be recognized that as a consequence of the configuration of the fluid tubes 42 and 43, and the resulting complex combination of linear and serpentine gas flow through the first and third level passageways, there is an efficient exchange of heat from the combustion gases to the liquid within the tubes 42 and 43. Further, heat is transferred to liquid within the tubes 98 and 100, and liquid within the upper and lower drums 36 and 30. As the liquid is heated, steam is generated in the upper drum 36, and removed from the boiler 10 through the steam outlet 39. The water or other medium within the upper drum 36 which remains in a liquid state is communicated through the downcomers 45 and 47 to the lower drum 30 for recirculation.

In view of the above, it will be recognized by those skilled in the art that the boiler 10 provides great advantages over the prior art. The configuration of the fluid tubes 42, 43, 98 and 100 provides for a flow of hot gas through the boiler 10 which greatly increases heat transfer to the liquid within the various tubes, and greatly increases the efficiency of the boiler 10 when compared to boilers of the prior art. While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

I claim:

1. A boiler in which a liquid medium is heated, said boiler comprising:

a housing having first and second ends;

a lower drum for receiving the liquid medium, at least a portion of said lower drum being disposed within said housing;

an upper drum at least a portion of which is disposed within an upper portion of said housing, said upper drum having an outlet;

at least a first tube bank disposed within said housing on a first side of said upper drum, said first tube bank including a plurality of first fluid tubes for establishing fluid communication between said lower drum and said upper drum, each said first fluid tube defining at least one inwardly extending portion;

at least a second tube bank disposed within said housing on a second side of said upper drum, said second tube bank being disposed substantially opposite said first tube bank, said second tube bank including a plurality of second fluid tubes for establishing fluid communication between said lower drum and said upper drum, each said second fluid tube defining at least one inwardly extending portion which is longer than said inwardly extending portions of said first fluid tubes of said first tube bank, whereby said first and second tube banks define a combustion area within said housing, and cooperatively define with said housing at least a first level of passageways for communicating hot gases;

a burner for generating hot gases within said combustion area; and means for communicating hot gases from said combustion area to said first level of passageways and for communicating hot gases from said first level of passageways to said upper portion of said housing, whereby heat from said hot gases is transferred to the liquid medium within said first and second fluid tubes thereby heating the liquid medium.

2. The boiler of claim 1 wherein said boiler further comprises at least one said first tube bank on said second side of said upper drum, and at least one said second tube bank on said first side of said upper drum, said first tube bank on said second side of said upper drum being disposed substantially opposite said second tube bank on said first side of said upper drum, whereby said first level of passageways defines at least three passageways providing linear paths for hot gases to travel.

3. The boiler of claim 1 wherein said boiler comprises a plurality of said first and second tube banks alternately disposed on said first side of said upper drum, and a plurality of first and second tube banks alternately disposed on said second side of said upper drum, each said first tube bank being disposed opposite one said second tube bank, whereby said first level of passageways defines at least three passageways providing linear paths for hot gases to travel and whereby serpentine gas flow between said three passageways is permitted.

4. The boiler of claim 1 wherein each said first fluid tube defines a second inwardly extending portion above said first inwardly extending portion of said first fluid tube, and wherein each said second fluid tube defines a second inwardly extending portion above said first inwardly extending portion of said second fluid tube, whereby said first and second tube banks define said first level of passageways, a second level passageway, and a third level of passageways.

5. The boiler of claim 4 wherein said boiler comprises a plurality of said first and second tube banks alternately disposed on said first side of said upper drum, and a plurality of first and second tube banks alternately disposed on said second side of said upper drum, each said first tube bank being disposed opposite one said second tube bank, whereby said first and third levels of passageways each define at least three passageways providing linear paths for hot gases to travel and whereby serpentine gas flow between said passageways of said first level of passageways is permitted and serpentine gas flow between said passageways of said third level of passageways is permitted.

6. A boiler in which a liquid medium is heated, said boiler comprising:

a housing having first and second ends, and an upper interior portion;

a lower drum for receiving the liquid medium, at least a portion of said lower drum being disposed within said housing;

an upper drum at least a portion of which is disposed within an upper portion of said housing, said upper drum having an outlet and first and second sides;

a plurality of first tube banks disposed within said housing on each said first and second side of said upper drum, each said first tube bank including a plurality of first fluid tubes for establishing fluid communication between said lower drum and said upper drum, each said first fluid tube defining at least a first inwardly extending portion;

a plurality of second tube banks disposed within said housing on each said first and second side of said upper drum, each said second tube bank being disposed substantially opposite one of said first tube banks; each said second tube bank including a plurality of second fluid tubes for establishing fluid communication between said lower drum and said upper drum, each said second fluid tube defining at least a first inwardly extending portion which is longer than said inwardly extending portions of said first fluid tubes of said first tube banks, said first and second tube banks being alternately disposed along said first and second sides of said upper drum, whereby said first and second tube banks define a combustion area within said housing and cooperatively define with said housing at least a first level of passageways for communicating hot gases, said first level of passageways including first, second and third passageway, whereby linear flow of hot gases is permitted through said first, second and third passageways, and serpentine flow of hot gases is permitted between said first, second and third passageways;

a burner mounted at said first end of said housing for generating hot gases within said combustion area; and means for communicating hot gases from said combustion area to said first level of passageways proximate said second end of said housing, and for communicating hot gases from said first level of passageways to said upper interior portion of said housing whereby heat from said hot gases is transferred to the liquid medium within said first and second fluid tubes thereby heating the liquid medium.

7. The boiler of claim 6 wherein each said first fluid tube defines a second inwardly extending portion, and each said second fluid tube defines a second inwardly extending portion, said second inwardly extending portion each of said second fluid tubes being longer than said second inwardly extending portions of said first fluid tubes, whereby said first and second tube banks define a second level passageway between said first and second inwardly extending portions of said first and second fluid tubes, and said first and second tube banks define a third level of passageways defining first, second and third passageways.

8. The boiler of claim 7 wherein said means for communicating hot gases from said combustion area to said first level of passageways proximate said second end of said housing, and for communicating hot gases from said first level of passageways to said upper portion of said housing, further communicates hot gases from said first level of passageways to said second level passageway proximate said first end of said housing, communicates hot gases from said second level passageway to said third level of passageways proximate said second end of said housing, and communicates hot gases from said third level of said passageways to said upper interior portion of said housing proximate said first end of said housing.

9. The boiler of claim 8 wherein each said first fluid tube defines a lower leg portion which extends a selected distance from said lower drum outwardly toward an associated sidewall of said housing, and bends to define an upwardly extending portion communicating with said first inwardly extending portion of said first fluid tube, each said first and second inwardly extending portion of each said first fluid tube having a first tube run extending inwardly away from said associated sidewall of said housing and a reverse bend extending from said first tube run to a second tube run extending toward said associated sidewall of said housing, each said first fluid tube having a further reverse bend joining said first and second inwardly extending portions of said first fluid tube, and each said first fluid tube extending upwardly from said second inwardly extending portion and defining a further tube run terminating at said upper drum, and wherein each said second fluid tube defines a lower leg portion which extends a selected distance from said lower drum outwardly toward an associated sidewall of said housing, and bends to define an upwardly extending portion communicating with said first inwardly extending portion of said second fluid tube, each said first and second inwardly extending portion of each said second fluid tube having a first tube run extending inwardly away from said associated sidewall of said housing and a reverse bend extending from said first tube run to a second tube run extending toward said associated sidewall of said housing, each said second fluid tube having a further reverse bend joining said first and second inwardly extending portions of said second fluid tube, and each said second fluid tube extending upwardly from said second inwardly extending portion and defining a further tube run terminating at said upper drum.

10. The boiler of claim 9 wherein said means for communicating hot gases from said combustion area to said first level of passageways proximate said second end of said housing, and for communicating hot gases from said first level of passageways to said upper portion of said housing includes a plurality of oppositely disposed third fluid tubes proximate said second end of said housing communicating between said lower drum and said upper drum, and a plurality of oppositely disposed fourth fluid tubes proximate said first end portion of said housing communicating between said lower drum and said upper drum, said third fluid tubes being bent to permit hot gases to be communicated from said combustion area to said first level passageways, and from said second level passageway to said third level passageways, said fourth fluid tubes being bent to permit hot gases to be communicated from said first level passageways to said second level passageway, and from said third level passageways to said upper interior portion of said housing.

11. The boiler of claim 10 wherein each said third fluid tube defines a lower leg portion which extends a selected distance from said lower drum outwardly toward an associated sidewall of said housing and bends to define an upwardly extending portion, each said third tube defining at least one inwardly extending portion having an inwardly extending tube run, an upwardly extending tube run, and an outwardly extending tube run, said third fluid tube extending upwardly from said inwardly extending portion of said third fluid tube and defining a further tube run terminating at said upper drum.

12. The boiler of claim 11 wherein each said fourth fluid tube defines a lower leg portion which extends a selected distance from said lower drum outwardly toward an associated sidewall of said housing and bends to define an upwardly extending portion, each said fourth fluid tube defining at least one inwardly extending portion having an inwardly extending tube run, an upwardly extending tube run, and an outwardly extending tube run, each said fourth fluid tube extending upwardly from said inwardly extending portion of said fourth fluid tube and defining a further tube run terminating at said upper drum.

13. The boiler of claim 8 wherein said means for communicating hot gases from said combustion area to said first level of passageways proximate said second end of said housing, and for communicating hot gases from said first level of passageways to said upper portion of said housing includes a plurality of oppositely disposed third fluid tubes proximate said second end of said housing communicating between said lower drum and said upper drum, and a plurality of oppositely disposed fourth fluid tubes proximate said first end portion of said housing communicating between said lower drum and said upper drum, said third fluid tubes being bent to permit hot gases to be communicated from said combustion area to said first level passageways, and from said second level passageway to said third level passageways, said fourth fluid tubes being bent to permit hot gases to be communicated from said first level passageways to said second level passageway, and from said third level passageways to said upper interior portion of said housing.

14. A boiler in which a liquid medium is heated, said boiler comprising:

a housing having first and second ends, and an upper interior portion;

a lower drum for receiving the liquid medium, at least a portion of said lower drum being disposed within said housing;

an upper drum at least a portion of which is disposed within an upper portion of said housing, said upper drum having an outlet and first and second sides;

a plurality of first tube banks disposed within said housing on each said first and second side of said upper drum, each said first tube bank including a plurality of first fluid tubes for establishing fluid communication between said lower drum and said upper drum, each said first fluid tube defining a lower leg portion which extends a selected distance from said lower drum outwardly toward an associated sidewall of said housing and bends to define an upwardly extending portion communicating with a first inwardly extending portion of said first fluid tube, said first inwardly extending portion including a first tube run extending inwardly from said upwardly extending portion away from said associated sidewall of said housing and including a reverse bend extending from said first tube run to a second tube run extending toward said associated sidewall of said housing where said first fluid tube defines a further reverse bend, said first fluid tube further defining a second inwardly extending portion including a first tube run extending inwardly from said further reverse bend away from said associated sidewall of said housing and including a reverse bend extending from said first tube run to a second tube run extending toward said associated sidewall of said housing, said first fluid tube extending upwardly from said second inwardly extending portion and defining a further tube run terminating at said upper drum;

a plurality of second tube banks disposed within said housing on each said first and second side of said upper drum, each said second tube bank being disposed substantially opposite one of said first tube banks, each said second tube bank including a plurality of second fluid tubes for establishing fluid communication between said lower drum and said upper drum, each said second fluid tube defining a lower leg portion which extends a selected distance from said lower drum outwardly toward an associated sidewall of said housing and bending to define an upwardly extending portion communicating with a first inwardly extending portion of said second fluid tube, said first inwardly extending portion of said second fluid tube including a first tube run extending inwardly from said upwardly extending portion away from said associated sidewall of said housing and including a reverse bend extending from said first tube run to a second tube run extending toward said associated sidewall of said housing where said second fluid tube defines a further reverse bend, said second fluid tube further defining a second inwardly extending. portion including a first tube run extending inwardly from said further reverse bend of said second fluid tube away from said associated sidewall of said housing, and including a reverse bend extending from said first tube run of said second inwardly extending portion of said second fluid tube to a second tube run extending toward said associated sidewall of said housing, said second fluid tube extending upwardly from said second inwardly extending portion and defining a further tube run terminating at said upper drum, said first and second inwardly extending portions of said second fluid tubes being longer than said first and second inwardly extending portions of said first fluid tubes, and said first and second tube banks being alternately disposed along said first and second sides of said upper drum, whereby said first and second tube banks define a combustion area within said housing, cooperatively define with said housing at least a first level of passageways for communicating hot gases, define a second level passageway for communicating hot gases, and cooperatively define with said housing a third level of passageways, said first level of passageways including a first, second and third passageways and said third level of passageways including first, second and third passageway;

a burner mounted at said first end of said housing for generating hot gases within said combustion area; and a plurality of oppositely disposed third fluid tubes proximate said second end of said housing communicating between said lower drum and said upper drum, and a plurality of oppositely disposed fourth fluid tubes proximate said first end portion of said housing communicating between said lower drum and said upper drum, said third fluid tubes being bent to permit hot gases to be communicated from said combustion area to said first level passageways, and from said second level passageway to said third level passageways, said fourth fluid tubes being bent to permit hot gases to be communicated from said first level passageways to said second level passageway, and from said third level passageways to said upper interior portion of said housing.

15. The boiler of claim 14 wherein each said third fluid tube defines a lower leg portion which extends a selected distance from said lower drum outwardly toward an associated sidewall of said housing and bends to define an upwardly extending portion, each said third tube defining at least one inwardly extending portion having an inwardly extending tube run, an upwardly extending tube run, and an outwardly extending tube run, said third fluid tube extending upwardly from said inwardly extending portion of said third fluid tube and defining a further tube run terminating at said upper drum.

16. The boiler of claim 15 wherein each said fourth fluid tube defines a lower leg portion which extends a selected distance from said lower drum outwardly toward an associated sidewall of said housing and bends to define an upwardly extending portion, each said fourth fluid tube defining at least one inwardly extending portion having an inwardly extending tube run, an upwardly extending tube run, and an outwardly extending tube run, each said fourth fluid tube extending upwardly from said inwardly extending portion of said fourth fluid tube and defining a further tube run terminating at said upper drum.

17. The boiler of claim 14 wherein said boiler includes a first downcomer disposed outside of said housing for establishing fluid communication between said upper drum and said lower drum.

18. The boiler of claim 17 wherein said boiler includes a second downcomer disposed outside of said housing for establishing fluid communication between said upper drum and said lower drum.

* * * * *